United States Patent [19]

Crawford

[11] 4,318,381

[45] Mar. 9, 1982

[54] AIR BLEED CONTROL SYSTEM IMPROVMENT

[75] Inventor: Edward N. Crawford, Defiance, Mo.

[73] Assignee: ACF Industries, Inc., New York, N.Y.

[21] Appl. No.: 237,991

[22] Filed: Feb. 25, 1981

[51] Int. Cl.[3] ..... F02M 7/00; F02M 23/00

[52] U.S. Cl. ..... 123/440; 123/589; 123/327; 137/630.19

[58] Field of Search ..... 123/585–589, 123/440, 327; 137/630.19, 630.22

[56] References Cited

U.S. PATENT DOCUMENTS

| | | | |
|---|---|---|---|
| 4,120,317 | 10/1978 | Skoyles | 137/630.19 |
| 4,254,754 | 3/1981 | Takada et al. | 137/625.48 |
| 4,287,864 | 9/1981 | Takada et al. | 123/438 |

*Primary Examiner*—Charles J. Myhre
*Assistant Examiner*—E. Rollins Cross
*Attorney, Agent, or Firm*—J. Joseph Muller

[57] ABSTRACT

A control system (1) for bleeding air into the high speed and low speed fuel circuits (HS and LS) of a carburetor (C) mounted on an internal combustion engine (E). The carburetor has an air passage (AP) to which fuel is delivered to mix with air and form a mixture combusted in the engine. Air is directed from an air inlet (9) through a first air flow path (5) to the high speed fuel circuit and through a second air flow path (7) to the low speed fuel circuit. An isolator (57) prevents crossover of air from one air flow path to the other. A flow control (77) opens and closes the first and second air flow paths, the flow control opening and closing both air flow paths substantially simultaneously.

12 Claims, 5 Drawing Figures

FIG. 3
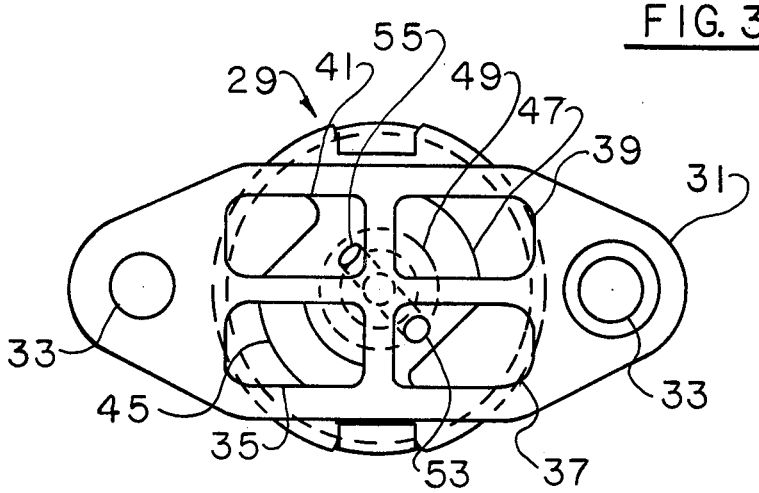
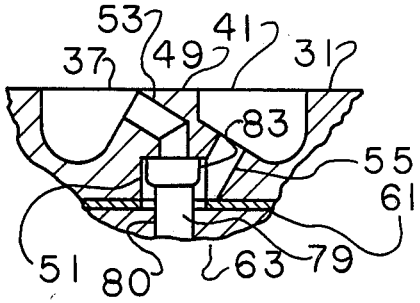
FIG. 5
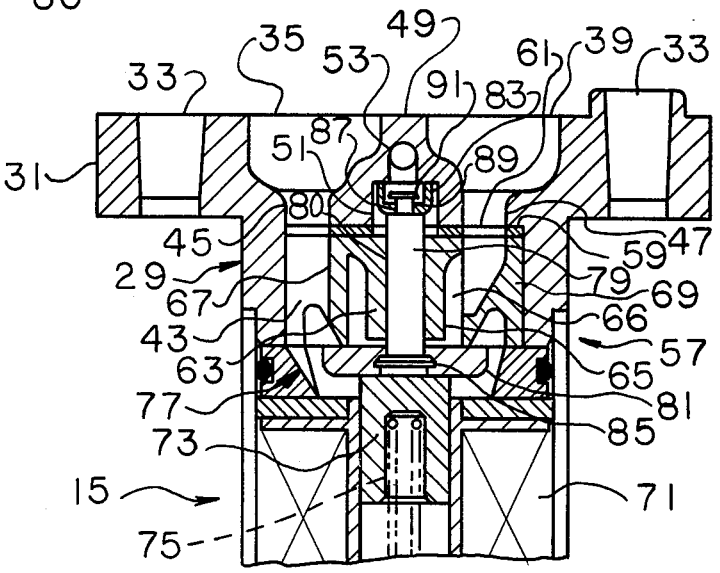
FIG. 4

AIR BLEED CONTROL SYSTEM IMPROVMENT

BACKGROUND OF THE INVENTION

This invention relates to fuel control systems for automobile engines and, more particularly, to an improvement for such a system in which a pulsed solenoid is used.

U.S. Pat. Ser. No. 108,483, filed Dec. 31, 1979, and assigned to the same assignee as the present invention, describes a pulsing solenoid improvement by which bleed air to fuel circuits of a carburetor is controlled. While the improvement described in this application does perform satisfactorily, further study has shown the desirability of varying the quantity of air supplied to the high speed fuel circuit from that supplied to the low speed fuel circuit. In addition, it was determined that one bleed path should be opened prior to the opening of the other bleed path. This is because such a sequence makes it easier to overcome the vacuum forces present on the bleed air system.

SUMMARY OF THE INVENTION

Among the several objects of the present invention may be noted the improvement in a fuel control system for an internal combustion engine; the provision of such an improvement which permits a single solenoid to control bleeding of air to both the high speed and low speed fuel circuits of a carburetor, the quantity of air bled to each fuel circuit differing; the provision of such an improvement by which isolation between air bleed paths to the fuel circuits is maintained; and the provision of such an improvement which readily overcomes engine vacuum effects on solenoid operation to easily and efficiently bleed air to both carburetor fuel circuits.

Briefly, the improvement of the present invention is used in a control system for bleeding air into the high speed and low speed fuel circuits of a carburetor mounted on an internal combustion engine. The carburetor has an air passage to which fuel is delivered through the fuel circuits to mix with air and form a mixture combusted in the engine. The control system utilizes a solenoid to control bleeding of air into the fuel circuits to control the air-fuel ratio of the mixture produced. The improvement comprises a first air flow path by which air is directed from an air inlet to the high speed fuel circuit and a second air flow path by which air is directed from the inlet to the low speed fuel circuit. The first air flow path is isolated from the second air flow path so air flowing through one air flow path cannot crossover to the other air flow path. Flow control means are provided for opening and closing the first and second air flow paths, the flow control means opening one flow path prior to opening the other flow path and closing both air flow paths substantially simultaneously. Other objects and features will be in part apparent and in part pointed out hereinafter.

BRIEF DESCRIPTION OF THE DRAWINGS

FIG. 3 is a bottom plan view of a pulsing solenoid unit attached to the carburetor of FIG. 2;

FIG. 4 is a side elevational view, in section of a portion of the solenoid unit; and, FIG. 5 is a second sectional view of a portion of the solenoid unit shown in FIG. 4.

Corresponding reference characters indicate corresponding parts throughout the several views of the drawings.

DESCRIPTION OF A PREFERRED EMBODIMENT

Figure 1:
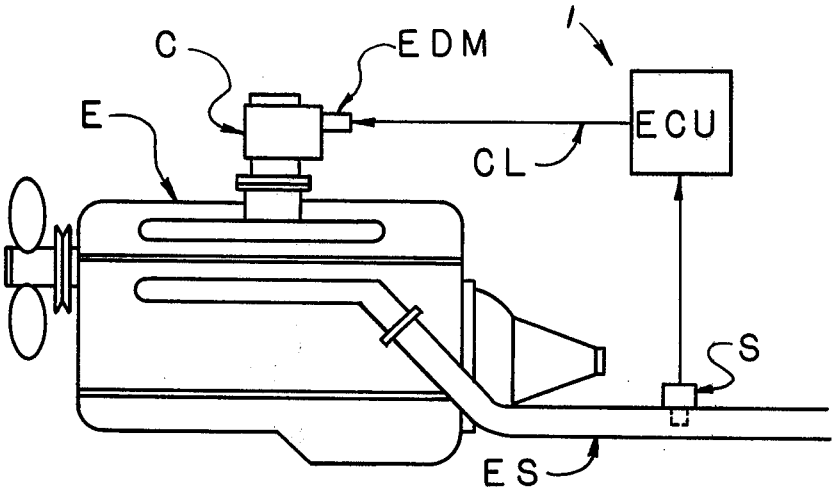
FIG. 1 is a schematic representation of a fuel control system for an internal combustion engine.

Referring to the drawings, a control system for an internal combustion engine E is generally indicated 1 in FIG. 1. Engine E has a carburetor C mounted thereon and control system 1 is designed to control the air-to-fuel ratio of the mixture produced in the carburetor and combusted in the engine. For this purpose, the control system includes an oxygen sensor S located in an exhaust system ES of the engine. Sensor S senses the oxygen content in the engine exhaust and generates an electrical signal representative of this content. The signal is supplied to an electronic circuit unit ECU which processes the signal and generates a control signal supplied over a line CL to an electromechanical control device EMD. The net result obtained with control system 1 is better management of the air-fuel ratio and the reduction of engine emissions.

Figure 2:
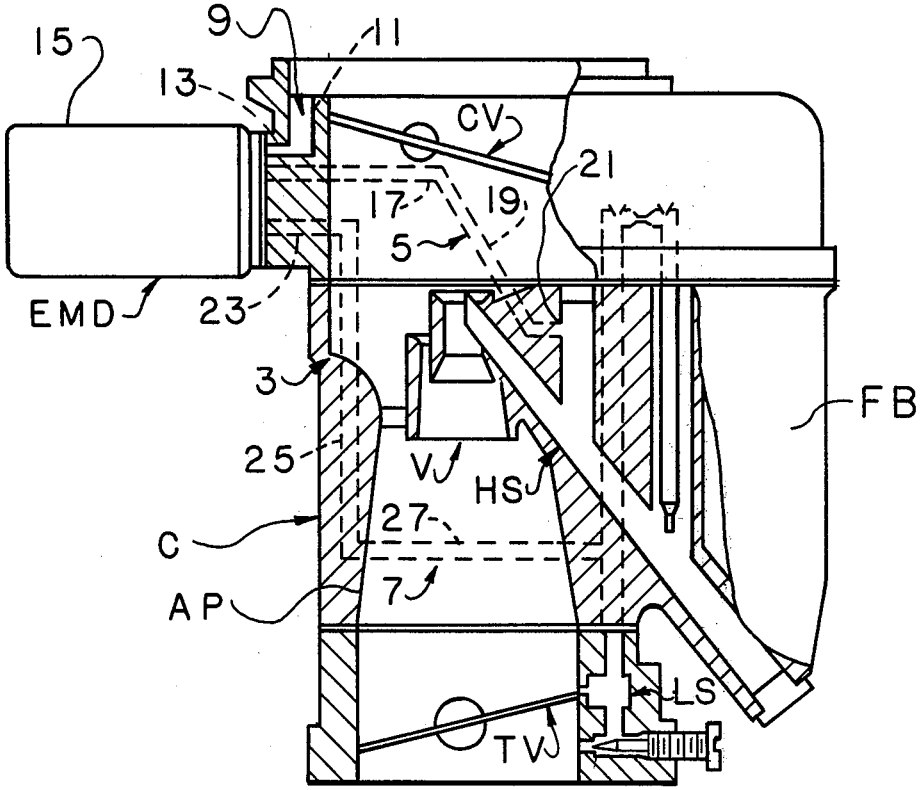
FIG. 2 is a side elevational view of a carburetor, partially in section, illustrating operation of a portion of the fuel control system.

Referring to FIG. 2, carburetor C is shown to have an air passage AP with a choke valve CV at its inlet, a throttle valve TV near its outlet and a stacked venturi section generally indicated V intermediate the length of the air passage. A fuel bowl FB serves as a reservoir of fuel supplied to air passage AP through either of two fuel circuits. The first of these is a high speed fuel circuit indicated generally HS. Fuel is delivered through this circuit when engine E is operating at an rpm level somewhat higher than its idle level. The second of the fuel circuits is a low speed fuel circuit generally indicated LS. Fuel is delivered through this circuit when engine E is at idle or no load conditions. Operation of both the high and low speed circuits to deliver fuel from fuel bowl FB to air passage AP is well known in the carburetor art and will not be described in detail.

The improvement of the present invention comprises an air bleed means 3 defining a high speed air bleed path 5 for bleeding auxiliary air drawn into carburetor C to high speed fuel circuit HS and a low speed air bleed path 7 for bleeding air to low speed fuel circuits LS. Means 3 includes an auxiliary air intake passage 9 whose inlet is adjacent the inlet of air passage AP. Passage 9 has a vertical section 11 leading to a horizontal section 13. Air flowing through passage 9 enters electromechanical device EMD which is a solenoid unit 15 whose construction and operation is described hereinafter. From solenoid unit 15, air bleed path 5 includes a horizontal section 17 and a downwardly extending section 19 whose outlet opens into the high speed circuit at an anti-percolation well 21. Similarly, air bleed 7 includes a first horizontal section 23, a vertical section 25, and a second horizontal section 27 whose outlet opens into a vertical section of low speed circuit LS at a point somewhat above throttle valve TV. Air introduced into either fuel circuit via its respective air bleed path changes the pressure or vacuum signal to which the fuel circuit is subjected. This, in turn, effects the quantity of fuel drawn through the fuel circuit and thus the air-fuel ratio of the resultant mixture produced in air passage AP. It will be understood that two separate intake passages 9 are provided, only one path being shown for sake of drawing clarity, each separate passage forming a portion of air bleed path 5 or air bleed path 7. Solenoid unit 15 is responsive to the control signal applied to line CL to open and close air bleed paths 5 and 7 and thus control the quantity of air bled into the high speed and low speed fuel circuits.

Solenoid unit 15 has an air flow control section 29 with a flange 31 for attaching the solenoid unit to the side of carburetor C. Flange 31 includes bolt holes 33 for mounting bolts (not shown). The flange further includes apertures 35 and 37 respectively interfacing with the horizontal passages 13 from auxiliary air inlets 9, an aperture 39 interfacing with passage 17 of high speed air bleed path 5, and an aperture 41 interfacing with passage 23 of low speed air bleed path 7.

Flow control section 29 includes a central opening or cavity 43 and apertures 35 and 39 open into this cavity through respective flow passages 45 and 47. Flange 31 has a solid central section 49. The rearward face of section 49 has a cavity 51 and a passage 53 (see FIG. 5) extends from aperture 37 thorugh section 49 to the base of cavity 51. A second passage 55 (see FIG. 5) extends from outlet aperture 41 to an opening in the side of cavity 51.

An isolator bearing 57 fits in cavity 43 and seats against the rear wall of section 49 and a ledge 59 formed around a portion of the circumference of cavity 43. A seal 61 is interposed between the forward face of the bearing and the rear wall of section 49 and the base of ledge 59.

Bearing 57 has a central body section 63 in which an annular groove 65 is formed, the length of the groove being somewhat less than the length of the bearing. The groove, which defines an annular cavity 66, is asymetrical about the longitudinal axis of central body section 63. It is formed on the outer margin of a portion of body section 63, but extends into the body for the remainder of its path, thus creating a sidewall 67 adjacent flow passage 45. The isolator bearing has a sidewall section 69 opposite the portion of groove 65 cut into the outer margin of body section 63. Section 69 seats against ledge 59 and the inner wall of the section is cut away to provide an air flow path with passage 47. The area behind isolator bearing 57 is open so air flowing into solenoid unit 15 thorugh aperture 35 flows through passage 45 into cavity 43 and through cavity 66 to passage 47. At the same time, air entering passage 53 through aperture 37 flows through cavity 51 and hence through passage 55 to aperture 41. The former flow path is that for air being introduced into the high speed fuel circuit while the latter path is for air introduced into the low speed circuit.

Solenoid unit 15 has a winding 71 and a movable armature 73 biased forwardly by a spring 75. A flow control means 77 is operated by solenoid unit 15 to open and close the air flow paths through flow control section 29. Flow control means 77 comprises a stem 79 attached to armature 73 and movable therewith. Stem 79 extends forwardly from armature 73 through cavity 43, through a central bore 80 in body section 63 of isolator bearing 57, and into cavity 51. The flow control means next includes first and second sealing members 81 and 83 respectively, for sealing cavities 66 and 51 to prevent flow of air through these cavities. Sealing member 81 comprises a pad carried at the end of stem 79 attached to armature 73. The stem has an enlarged diameter shoulder 85 over which the pad fits and one side of the pad abuts the outer end of the armature. The pad has diameter sufficiently large so the pad completely covers the open end of cavity 66 thus blocking flow of air into the cavity.

Sealing member 83 is cup-shaped with the open end of the member seating against the inner wall of cavity 51. The sealing member has an opening 87 in its base and stem 79 has a reduced diameter section 89 at its distal end fitting into this opening. The length of section 89 is longerthan the thickness of the cup base and the outer end of section 89 has a cap 91 for capturing sealing member 81 on the outer end of stem 79. The outer base wall of sealing member 83 abuts the shoulder formed on stem 79 where reduced diameter section 89 begins.

As shown in FIG. 4, when no signal is supplied to solenoid unit 15 by electronic control unit ECU, spring 75 urges armature 73 forwardly (upwardly as shown in FIG. 4) and pad 81 is pressed against the outer end of isolator bearing 57 to seal off cavity 66. In addition, sealing member 83 is pressed against the inner wall of cavity 51 by the shoulder formed at the end of the regular diameter portion of stem 79. As noted, pad 81 completely blocks off cavity 66 so air flowing into aperture 35 cannot flow to aperture 39 through cavity 43 and cavity 66. Further, sealing member 83 prevents air flowing into aperture 37 from flowing to aperture 41 through passage 53, cavity 51, and passage 55.

When a signal is supplied on line CL to windings 71 of solenoid unit 15, armature 73 is drawn back (downwardly) from its FIG. 4 position. Pad 81 is immediately drawn away from the end of isolator bearing 57 thus exposing cavity 66. Air is now drawn through the cavity to air flow path 5. Sealing member 83, however, remains at its closed position until cap 91 contacts the inner wall of the sealing member base and draws the sealing member away from the inner wall of cavity 51. Thus, sealing member 81 initially rides on reduced diameter section 89 of stem 79. The lost motion action resulting from this construction thus insures that the air passage from aperture 37 to aperture 41 is not opened until after the air passage between apertures 35 and 39 has opened. This is done to facilitate opening of the flow passages against engine vacuum forces which act on the sealing members. When the latter flow passage is opened, air passes to air flow path 7.

When solenoid unit 15 is deenergized, spring 75 forces armature 73 back to its original position and sealing members 81 and 83 move to close their respective air flow paths. The sealing members close the paths substantially simultaneously to block air flow to both air flow paths 5 and 7.

It will be understood that solenoid unit 15 may be supplied electrical signals from electronic control unit ECU many times a second and that the signals may have a varying frequency and a varying length. Thus the quantity of air flowing through flow control unit 29 to each air flow path can change greatly over time. Further, the air passages in air flow control unit 29 for air flow path 5 are larger than the air passages for air flow path 7 so a larger quantity of air is supplied to air flow path 5 at any one time than is supplied to air flow path 7.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a control system for bleeding air into the high speed and low speed fuel circuits of a carburetor mounted on an internal combustion engine, the carburetor having an air passage to which fuel is delivered through the fuel circuits to mix with air and form a mixture combusted in the engine, the control system including a solenoid to control the bleeding of air into the fuel circuits to control the air-fuel ratio of the mixture produced, the improvement comprising means defining a first air flow path by which air is directed from an air inlet to the high speed fuel circuit and a second air flow path by which air is directed from the inlet to the low speed fuel circuit, means for isolating the first air flow path from the second air flow path so air flowing through one air flow path cannot crossover to the other air flow path, and flow control means for opening and closing the first and second air flow paths, the flow control means opening one flow path prior to opening the other flow path and closing both air flow paths substantially simultaneously.

2. The improvement of claim 1 wherein the first air flow path includes a first cavity through which air flows, the second flow path includes a second and separate cavity through which air flows and the flow control means includes means for simultaneously blocking the flow of air through both cavities.

3. The improvement of claim 2 wherein the solenoid includes a movable armature and the flow control means includes a stem attached to the armature and movable therewith, the stem extending into both the first and second cavities.

4. The improvement of claim 3 wherein the flow control means includes first and second sealing members carried by the stem, the first sealing member sealing the first cavity and the second sealing member sealing the second cavity.

5. The improvement of claim 4 wherein the first cavity is an annular cavity and the first sealing member comprises a pad for blocking an open end of the cavity.

6. The improvement of claim 4 wherein the second sealing member is carried on the end of the stem, the stem having a reduced diameter section adjacent its end on which the second sealing member rides, the reduced diameter section providing a lost motion action by which the second sealing member continues to block the flow of air through the second cavity for a brief period after the solenoid moves the stem from a first position in which both air flow paths are blocked toward a second position in which both air flow paths are open.

7. The improvement of claim 6 wherein the second sealing member is cup-shaped and blocks an air entry port to the second cavity.

8. The improvement of claim 2 including an air flow control section attached to the solenoid for routing bleed air from an air inlet to the respective first and second air flow paths.

9. The improvement of claim 8 wherein the air flow control section includes a mating flange for attaching the solenoid to the carburetor, the flange having inlet and outlet apertures for both the high speed and low speed fuel circuits whereby air flows from the air inlet to the high speed and low speed fuel circuits through the air flow control section.

10. The improvement of claim 8 wherein the air flow control section has a central opening and the isolation means includes an isolator bearing fitting in the opening, the isolator bearing preventing crossover of air from one cavity to the other.

11. The improvement of claim 10 wherein the isolator bearing has a central body section in which the first cavity is formed.

12. The improvement of claim 11 wherein the first cavity is an annular cavity formed asymetrically around the longitudinal axis of the central body portion of the isolator bearing.

* * * * *